US006959716B1

(12) United States Patent
Schrader

(10) Patent No.: US 6,959,716 B1
(45) Date of Patent: Nov. 1, 2005

(54) ERGONOMICALLY DESIGNED WALKER

(76) Inventor: Joseph Francis Schrader, Campion Rd., New Hartford, NY (US) 13413

( * ) Notice: Subject to any disclaimer, the term of this patent is extended or adjusted under 35 U.S.C. 154(b) by 0 days.

(21) Appl. No.: 09/699,328

(22) Filed: Oct. 30, 2000

(51) Int. Cl.[7] ..... A45B 3/00; A47C 1/00

(52) U.S. Cl. ..... 135/66; 135/67; 135/68; 482/75; 297/5; 297/183.1; 297/195.11

(58) Field of Search ..... 135/65, 67, 68, 135/66; 297/4, 5, 183.1, 195.11; 482/75, 482/66; 602/26, 28, 29; 623/27, 28; 280/14.27; D21/413; D12/130, 133, 129

(56) References Cited

U.S. PATENT DOCUMENTS

| | | | | |
|---|---|---|---|---|
| 2,778,370 | A * | 1/1957 | Chamblee | 135/68 |
| 2,915,760 | A * | 12/1959 | Bair | 623/27 |
| 3,254,659 | A * | 6/1966 | Williams | 135/69 |
| 3,272,210 | A * | 9/1966 | Boruvka | 135/69 |
| 4,141,375 | A * | 2/1979 | Tykwinski | 135/66 |
| 4,254,948 | A * | 3/1981 | Jacobs | 482/68 |
| 4,641,882 | A * | 2/1987 | Young | 297/183.1 |
| 5,178,595 | A * | 1/1993 | MacGregor | 482/75 |
| 5,300,016 | A * | 4/1994 | Marlatt | 602/16 |
| 5,411,313 | A * | 5/1995 | Counihan et al. | 297/118 |
| 5,524,658 | A * | 6/1996 | Schrader | 135/72 |
| 5,927,797 | A * | 7/1999 | Ferguson | 297/4 |
| 6,062,638 | A * | 5/2000 | Ferguson | 297/4 |
| 6,439,250 | B1 * | 8/2002 | Balan | 135/67 |
| 6,783,134 | B2 * | 8/2004 | Geary | 280/21.1 |
| 2003/0027689 | A1 * | 2/2003 | Chien | 482/23 |
| 2003/0222419 | A1 * | 12/2003 | Geary | 280/21.1 |
| 2004/0100044 | A1 * | 5/2004 | Monike et al. | 280/14.1 |

FOREIGN PATENT DOCUMENTS

| | | |
|---|---|---|
| DE | 4034755 | 5/1992 |
| FR | 2611492 | 9/1988 |
| RU | 2012315 | 5/1994 |

* cited by examiner

*Primary Examiner*—Robert Canfield
(74) *Attorney, Agent, or Firm*—Wall Marjama & Bilinski LLP

(57) ABSTRACT

A bicycle seat supported generally by a tubular V-shaped configuration with an offset seat post to allow for padded leg cradle supports, padded handles and adjusting handle grip bars. The bottom of the ergonomically designed offset walker frame has an adjustable rubber tip for height adjustment. The seat is on a fixed top post. The position can be adjusted up and down in height, forward and back and front to back. Using the handle grips the user can straddle the bicycle seat and rest the injured limb on the leg cradle supports without having to strap the injured limb to the walker frame. The walker frame has been ergonomically designed for balance. The tubular construction is comprised of a number of offsetting bends and spacers, which offset the leg cradle to the proper distance for comfort and balance. The padded handles are forward of the seat with rotating handle grip bars on the ends of the padded handles which gives the user more comfort and better control when using the walker frame making it possible to maintain better balance. The hands and wrists keep the frame in a vertical position and maintain control over the stabilization foot for better balance. The offset bends in the frame move the stabilization foot out of the way of the good leg and foot making for a less cumbersome and more comfortable natural stance. The stabilization foot is under the injured limb giving the injured user better balance, which improves comfort and makes for a simple easy to use walking device.

14 Claims, 4 Drawing Sheets

ERGONOMICALLY DESIGNED WALKER

BACKGROUND OF THE INVENTION

The present invention relates generally to a seated crutch that has handles and is ergonomically designed to promote balance and the natural position of the user.

When an injury to the lower leg, knee or foot or a leg amputation occurs, a wheelchair or crutches is the usual means for ambulating. There are a great number of orthopedic devices such as crutches and canes, the like of which have been satisfactory only to a certain extent. These devices help an injured person ambulate but do not take into account a person's need for natural positioning and balance while walking. When walking, the human body has its mass in motion. When this happens a number of factors come into play. This is best understood by using the model of a downhill skier. In order for the skier to maintain balance while in motion he needs to have a natural stance with his feet slightly apart and he needs to lean forward slightly, bending the ankles, knees and hips with elbows, wrists and hands forward of the hips. This gives the body a slight forward lean with dynamic joint alignment, promoting better balance.

Medical devices have been developed to facilitate ambulating. U.S. Pat. No. 4,641,882 issued Feb. 10, 1987 to John Young and entitled "Orthopedic Appliances" is for a device with a straight vertical seated post with a leg peg to support the injured leg, one or more handles mounted below the seat and a C-shaped leg receiver. Little consideration has been given to the problem of maintaining balance and keeping the body in a natural, flexible stance.

U.S. Pat. No. 5,524,658 issued Jun. 11, 1996 to Joseph F. Schrader and entitled "Sit To Stand Hinged Seat Walker With Pull-up Handles" also employs a vertical upright post with a planar seat that locks in a vertical position. The user's injured limb is strapped into the leg receiver. The straight V-shaped post from seat to tip is in a vertical line similar to Young's patent. Both of these devices allow the user to rest on the seat while walking.

It is the objective of this new and improved invention to provide an improved seated frame with raised forward handle grip bars to promote balance and with a leg cradle that the user may or may not strap on. The leg cradle is positioned in such a way that the injured limb helps promote balance. Due to the ergonomic bends in the walker frame, the seat support is offset from the stabilization foot, allowing the user to walk more normally while supporting the injured limb but not necessarily having to rest on the seat at all times. This balancing frame works similarly to a bicyclist riding along above the seat using his leg muscles to support the upper body, which in turn strengthens muscles.

Due to the configuration of the leg cradle, the walker can be easily mounted from an upright position. The walker frame is easier to use because an open leg frame cradles the injured limb allows it to be quickly removed if the need should arise.

BRIEF SUMMARY OF THE INVENTION

The present invention relates generally to an ergonomically designed walking system that provides an inexpensive simplified structure consisting essentially of a vertical tubular frame with offset bends, that provides a post and seat with padded handle grips and adjustable padded hand grip bars located at the uppermost end of the walker frame. This tubular frame consists mainly of two tubular support members: the generally V-shaped seat support with handle assembly and the offset frame support post handle assembly located at the upper end with a stabilization foot assembly located at the lower most end. The stabilization foot assembly is locked in position with a safety collar assembly, which minimizes wear on the adjustment button. Located above this assembly are threaded frame spacers, which maintain the proper distance between these two support members and give the walker frame the proper positioning of the seat post over the stabilization foot, which in turn, provides for the proper lateral balance for the intended user. These threaded frame spacers line up with the welded reinforcement tubes, which are located in both support members. Button head bolts pass through the welded reinforcement tubes and thread into the female threaded frame spacers. The leg cradle support and pivot flange assembly also rely on the button head bots and the welded reinforcement tubes for strength and rigidity. The adjustable leg cradle support tube with adjustment holes is located at the uppermost end of the leg cradle pivot flange assembly with the pivoting bracket affixed to the bottom of the padded leg cradle. This padded leg cradle may have a Velcro® strap or it may have a safety breakaway buckle.

The ergonomically designed walking frame of the present invention solves a long-standing problem of being able to ambulate with little effort and at the same time being able to have a strong stable stance with balance that allows for proper joint positioning. The joints, muscles and tendons work in a more natural, comfortable state which promotes faster healing because of the user's ability to extend and flex both the non injured limb and the injured limb to thereby maintain muscle mass and minimize atrophy. Being able to have extension and flexion helps to promote healing.

This walking device may be used in a number of different ways such as: helping to rise from a seated position, as a traditional walker with hands on seat and handle grip bars for stability, and climbing and going down stairs by holding on to rear of the seat with one hand while gripping the bar with the other hand with the walker frame facing sideways on the steps. One can have the walker frame on the step above while going upstairs, or the step below while going downstairs. It may also be used for walking, by straddling the walker frame and seat assembly, while resting on the seat only when needed. The walker enable the user to stand at a cabinet and have the widely spaced hand grip bars rest against a vertical surface, giving the user the use of his hands to do various tasks such a preparing food, brushing one's teeth or simply preparing a cup of coffee. The object of this invention is to provide a simple-to-use, stable device that is extremely adjustable for many users of different sizes with varying injuries. This would make it possible for the walker to be rented to those who would only need the device for a short time and then to be recycled back into use for another individual.

BRIEF DESCRIPTION OF THE DRAWINGS

For a better understanding of the invention, reference is made to the accompanying drawings, in which.

DETAILED DESCRIPTION OF THE INVENTION

Figure 1:
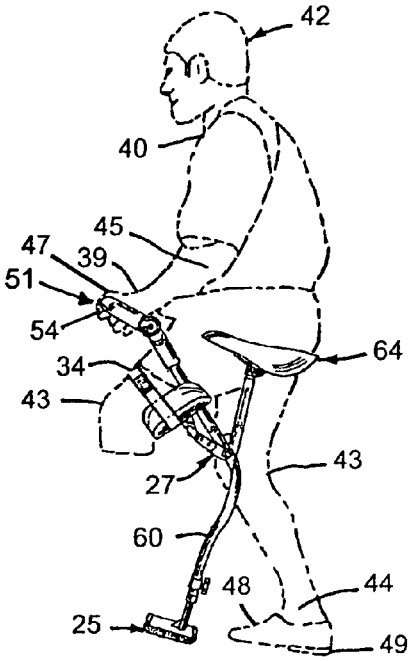
FIG. 1 is a perspective view of the left injured leg walker frame with leg cradle and Velcro® strap or breakaway buckle supporting a phantom person missing a left leg below the knee.

Referring to the drawings in greater detail, FIG. 1 shows an improved ergonomically designed walker frame 51 made according to the invention and supporting a phantom person 42, with his left leg missing below the knee 43, with the frame 51 coming to rest on a stabilization foot 25. The individual is in a natural comfortable stance with his hands 47, gripping padded handgrip bars 54, similar to that of U.S. Pat. No. 4,641,882. This improved walker frame facilitates the ability to control the balance of the individual in relationship to the stabilization foot 25. It should also be noted that the elbows 45 are at a comfortable distance apart, with the shoulders 40 facing the direction of movement with a slight forward lean as the person 42 rests upon the seat assembly 64.

Figure 2:
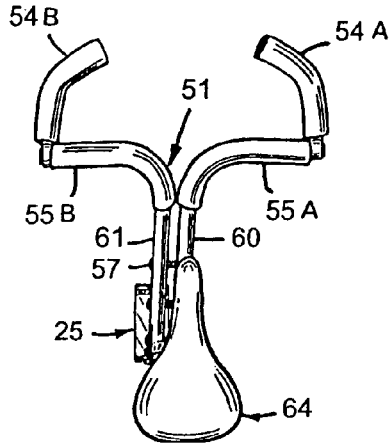
FIG. 2 is a top view of the left injured limb walker frame.

Referring now to FIG. 2, the walker 51 is shown in a top view, with an Ed to indicate the relationship between the foot stabilization assembly 25 and the seat assembly 64. The walker frame 51 is comprised principally of two tubular parts 60 and 61. An ergonomically configured offset frame support post 60 includes a foot assembly 25 at its lower end and a padded handgrip bar 54*a* at its top vertical end. The offset seat post 61 has opposing hand grip bar 54*b* located at the most top vertical end.

Figure 3:
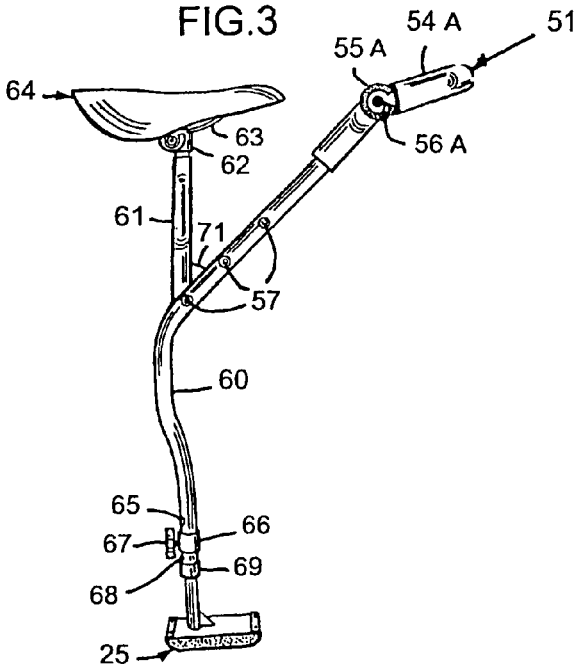
FIG. 3 is a right side elevational view showing upstanding left injured limb walker frame.

FIG. 3 is a right side elevational view showing one of two padded handgrip bars 55*a* located at the upper end of support post 60. The adjustable padded handgrip bar is affixed to the tapered top horizontal end of support post 60 and to the V-shaped seat support 61 with the cap screw 56*a* located at the lower end of the padded handgrip bar 54*a*. The offset seat support post 61 is generally a V shaped tubular structure with a bicycle seat 64 and is mounted on the highest vertical tapered end of said post with a bicycle seat adjustable mounting bracket 62, which clamps on the forward and aft adjustable seat bars 63.

Figure 4:
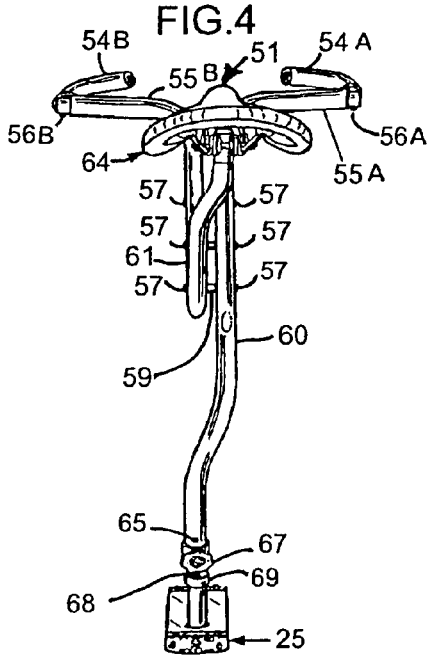
FIG. 4 is a rear elevational view of a left injured limb walker frame view of FIG. 3.

FIG. 4 is a rear elevational view showing padded handgrips 55*a* and 55*b* respectively located on the upper horizontal ends of the frame support post 60 and the offset seat post and handle assembly 61. Both the offset frame support post 60 & offset seat post and handle assembly 61 are preferably formed of lightweight high strength tubing such as aluminum, stainless steel, titanium, or a lightweight moldable composite material. The offset ergonomically formed frame support post 60 with its stabilization foot assembly 25 is held apart to a desired distance from the V shaped seat support post with handle assembly 61 by threaded frame spacers 59, to achieve proper lateral distance between offset frame support post 60 & offset seat post and handle assembly 61.

Figure 5:
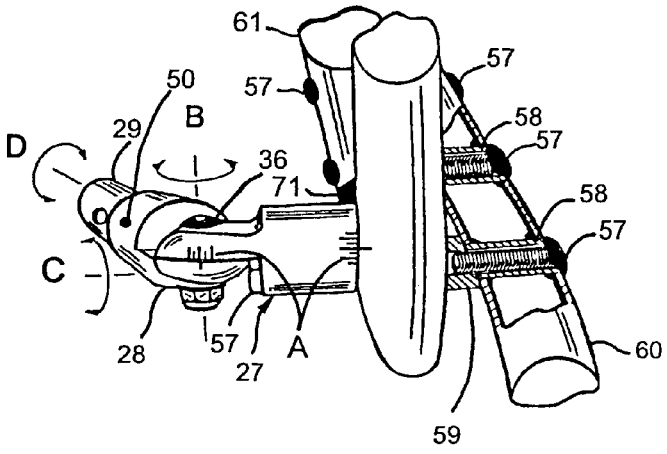
FIG. 5 is an enlarged perspective view of the rotation axes of the pivot flange assembly with letters B, C & D showing rotation directions of the pivot flange joint. Letter A shows degree hash marks on leg cradle pivot flange assembly.
Figure 6:
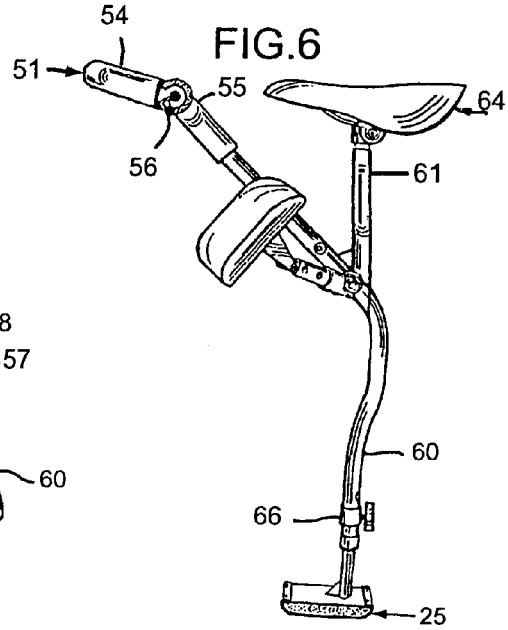
FIG. 6 is a left elevational view of FIG. 1 showing a left leg cradle without a Velcro strap or a phantom person.

FIG. 5 is an enlarged, detailed view of portions of the FIG. 6 embodiment but not showing the padded leg cradle assembly 33. The offset frame support post 60 and the V-shaped offset seat post and handle assembly 61 each have welded reinforced mounting tubes 58 spaced at equal distances apart to give added strength. Button head bolts 57, protruding latterly through these tubes and into the threaded frame spacers 59 can be tightened to the desired degree without crushing or distorting the frame support post 60 and handle assembly 61. The leg cradle pivot flange with offset bolt assembly 27 attaches to the seat support 61 using a lengthened button heat bolt 57 protruding through welded reinforcement tubes 58 located on offset seat support post 61, adjacent to gusset 71. Letter A shows degree markings and hash marks on the leg cradle pivot flange with offset bolt assembly 27. Letter b shows the lateral rotation of the leg cradle pivot flange with offset bolt assembly 27. Letter C shows the vertical rotation of the leg cradle pivot flange with offset bolt assembly 27. The leg cradle adjustment barrel with holes 29 is inserted into the pivot cap flange 28 and locked into the desired rotation by setscrew 50. Letter D shows the rotation axis of the leg cradle adjustment barrel 29.

Figure 7:
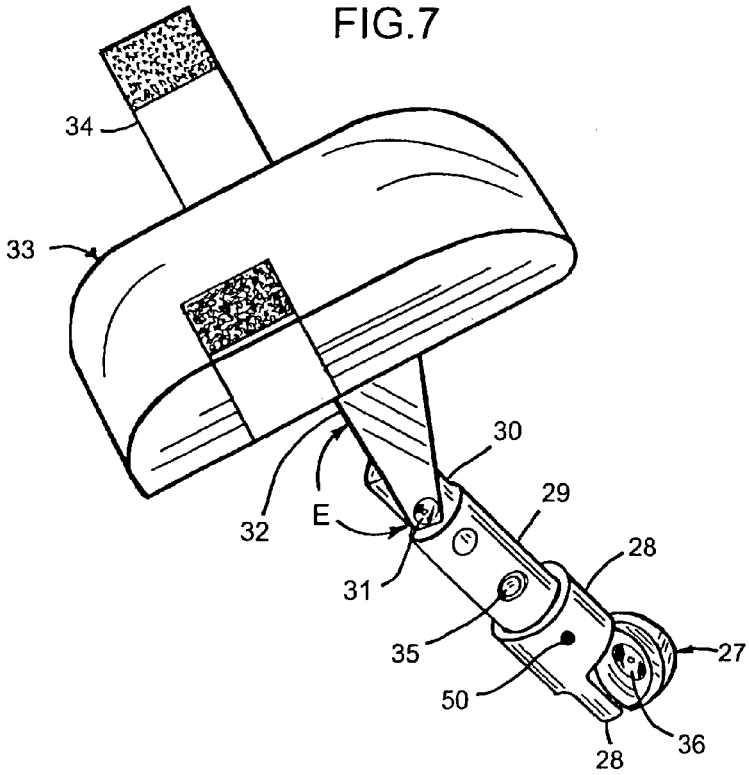
FIG. 7 is an enlarged perspective view of the padded leg cradle assembly with Velcro® strap with letter E showing direction of pivot rotation of leg cradle.

FIG. 7, shows an enlarged portion of the FIG. 6 embodiment showing in greater detail a padded leg cradle assembly 33, with optional Velcro® strap 34 as shown in use in FIG. 1 wherein the individual is affixed to the walker frame 51, which in some instances can be beneficial such as in climbing stairs. To secure the frame to the individual, the leg cradle 33, has a pivoting bracket 32, attached by means of the button head bolt and Nylock® nut assembly 31 to leg cradle inner support tube with height adjustment spring button assembly 35. As seen in FIG. 7, the leg cradle support bracket 32 pivots at the top of inner support tube 30, with the direction of rotational movement being illustrated by letter E.

Figure 8:
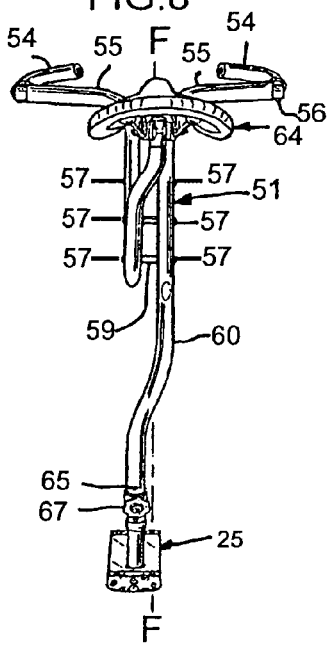
FIG. 8 is a rear elevational view of the FIG. 4 embodiment with wider threaded frame spacers to change the lateral balance point of the walking frame to accommodate a wider stabilization foot. Letter F shows the lateral balance point.

FIG. 8 is a rear elevational view of left injured limb walker frame 51, with larger threaded frame spacers 59. Reference line F shows the center of balance closer to the center of the stabilization foot assembly 25.

Figure 9:
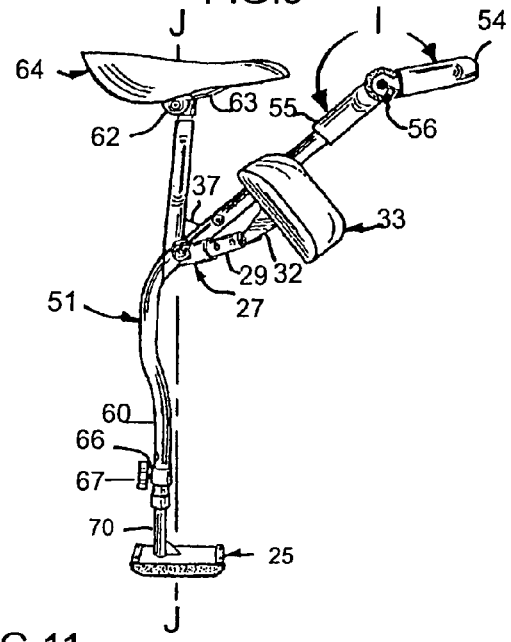
FIG. 9 is a right elevational view of a walker frame for a right injured leg with letter J showing the forward balance point of the frame over the stabilization foot. Letter I shows the padded handgrip bars adjustment rotation.

FIG. 9 shows a side elevational view of a walker 51 for a right leg injury. Reference line J shows the vertical center balance point of the seat assembly 64 to stabilization foot assembly 25 forward of foot support tube 70.

Figure 10:
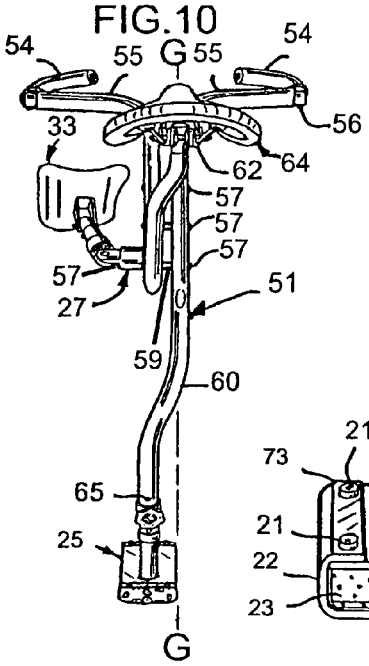
FIG. 10 is a rear elevational view of the FIG. 8 embodiment of a right injured limb walker with shorter frame spacers. Letter G shows a changed lateral balance point from the FIG. 8 lateral balance point.

FIG. 10 shows a rear elevational view of a left injured limb walker frame 51 with a left padded leg cradle assembly 33 with smaller threaded frame spacer 59. Reference line G. shows the vertical center balance line further to the right of the stabilization foot assembly 25 than shown in FIG. 8.

Figure 11:
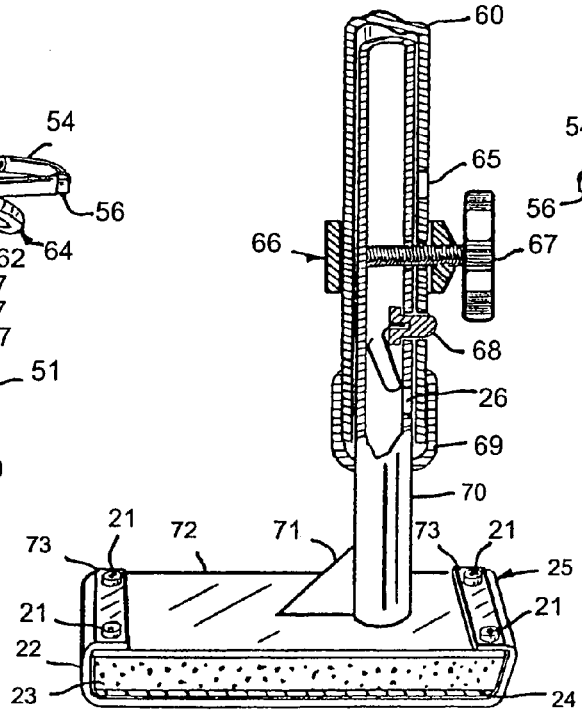
FIG. 11 is an enlarged side view of the stabilization foot assembly of FIG. 10 embodiment.

FIG. 11 is a left side partial cutaway view of the lower portion of the frame support post 60 and the attached stabilization foot assembly 25 and its foot support tube 70. FIG. 11 shows safety knob with threaded shaft 67, threading through safety collar assembly 66, diagonally passing through equally spaced height adjustment holes 65, in offset frame support post 60, also passing through equally spaced foot support tube holes 26, in foot support tube 70. This presses up against the inner support surface of tube 70, which presses outer surface of tube 70 to inner wall of offset frame support post 60, locking the two tubes together and giving a second means of fixing both tubes 60 and 70 to a desired height. Tightening the control knob 67 by hand can eliminate a slight amount of play between offset frame support post 60 and foot support tube 70. This will eliminate a clicking noise, which would be produced between these two support tubes and will minimize war on the height adjustment button 68 thus promoting safety.

Located directly below in the next two aligned holes 26 & 65, is the height adjustment button and spring assembly 68 to accommodate different height requirements. Located at the end of support tube 70 is support tube cap 69, which is used as a smoothing device between the two tubular sections, frame support post 60 & foot support tube 70. It is also a protective stop by not allowing locking safety collar assembly 66 to slide off when loosened for adjustment, which promotes safety.

FIG. 11 shows greater detail of the stabilization foot assembly 25, which is comprised of a foot support tube 70, that is welded to an upper stabilization plate 72, and one or more gussets 71 by means of a weld at right angles to achieve a 90 degree relationship between foot support tube 70 and upper stabilization plate with threaded holes 72. It should be recognized that the tube 70 has been positioned just forward of the rear trailing edge of plate 72, and centered similar to the proportions of the human foot. Located below the mounting plate 72 is a thick layer of foam 23 which can vary in density to accommodate the weight of the injured individual. Located below the foam 23 is the lightweight titanium or like stabilization plate 24, which is affixed to the rubber tread with reinforcement cord 22, by means of contact cement or the like. The rubber tread with reinforcement cord 22 has four mounting holes, two in front and tow in the rear. Rubber tread mounting bars 73, with equally spaced matching holes are placed over the rubber tread 22. Mounting bar cap screws 21, pass through these aligned holes and thread into matching threaded holes in the upper mounting plate 72. The rubber treads with cord wraps from the front to the rear of foot assembly 25, encapsulating the stabilization plate and foam in a tight, flat and secure manner. This stabilization foot assembly 25 can be made in varying sizes to facilitate a wider, more stable base for some users or a smaller, more lightweight base for the experienced user.

Figure 12:
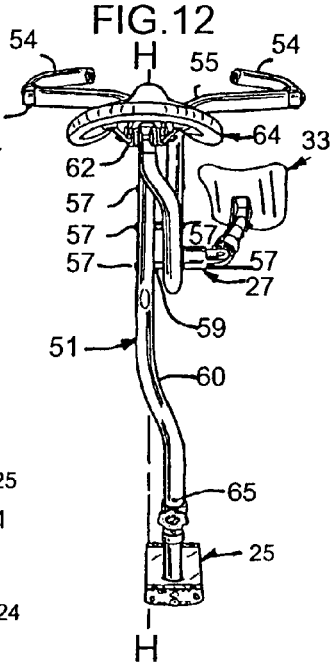
FIG. 12 is a rear elevational view of a right injured lamb walker with a right leg cradle assembly. Letter H shows the lateral balance point to the left side of the stabilization foot.
Figure 13:
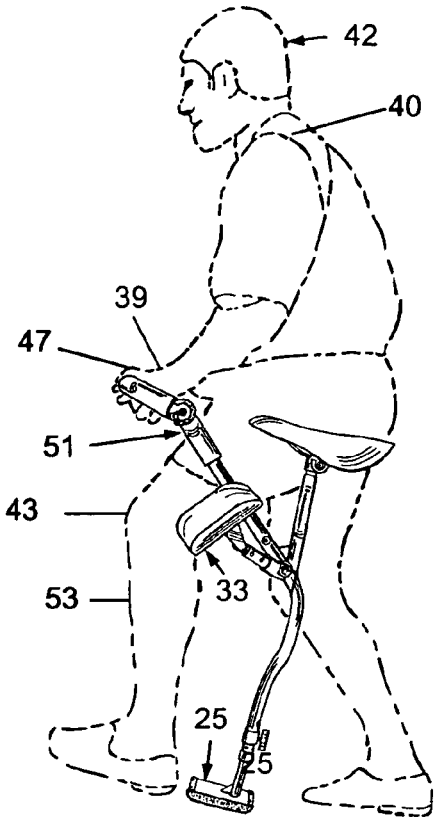
FIG. 13 is a side elevational view of a person walking with the left leg supported in a leg cradle.

FIG. 12 shows a rear elevational view of a right injured limb walker frame 51, with reference line H showing the vertical balance point to the left side of stabilization foot assembly 25. It is imperative that the vertical balance point is adjusted closer to the uninjured limb that is used for ambulating. The walker frame then supports more weight under the injured limb with stabilization foot assembly 25 underneath the vertical balance point making it possible to move walker stabilization foot assembly 25 further away from the uninjured foot. This helps improve the walker's performance by offsetting the balance slightly, making the walker lean towards the uninjured foot while ambulating FIG. 13 shows a phantom person using the improved ergonomically designed walker frame 51, with left lower leg demonstrating flexion 53, below the knee 43, with a leg cradle with no Velcro® strap. One is able to mount the walker without attaching a strap and to ambulate without being strapped in, but merely resting upon the leg cradle 33 without being restrained. This feature makes it far safer to get rid of the walker in case of fall.

Figure 14:
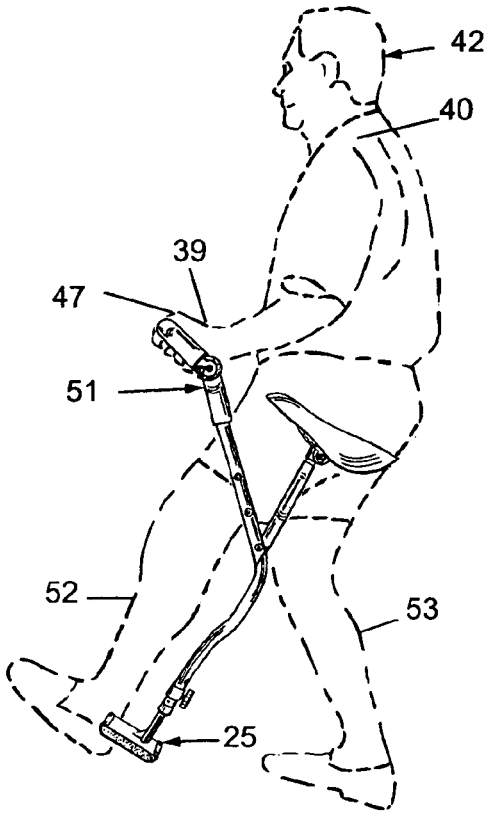
FIG. 14 is a side elevational view of a person walking with the left leg injured walker frame with no leg cradle. The phantom person is using selective weight bearing on the left injured limb having normal extension flexion of both legs.

FIG. 14 shows a phantom person using a left injured leg ergonomically designed walker frame 51, with no leg cradle, showing that it is possible to have extension 52 of lower leg and flexion of both legs with normal range of motion of both legs, at the same time being able to selectively weight bear on the left injured leg.

Figure 15:
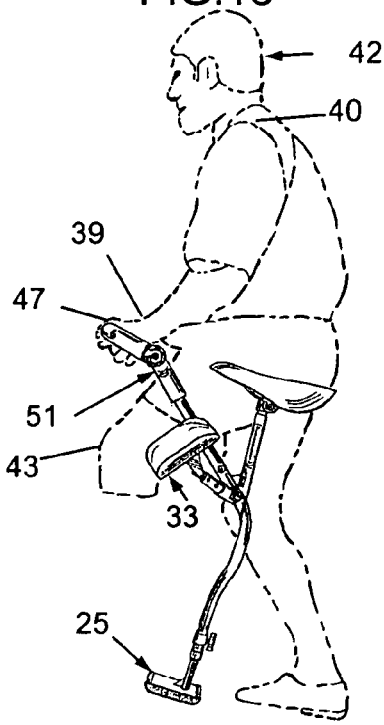
FIG. 15 is a side elevational view of a person missing the lower portion of his left leg using the left injured limb walker frame maintaining normal extension flexion of his right leg.

FIG. 15 shows a phantom person using a left injured leg ergonomically designed walker frame 51, with leg cradle supporting a partial leg amputated below the knee with no Velcro® strap or breakaway buckles. The phantom person is standing at a normal height resting comfortably on the stabilization foot maintaining good balance. FIGS. 1, 13, 14 and 15 all show a phantom person demonstrating proprioception of the stabilization foot by means of wrist 39 and hand 47.

It should be understood that while the invention has been described for reference to the structure disclosed here in, it is not confined to the details set forth, and this application is intended to cover such modifications or changes as may be made from the forgoing without departing from the spirit and scope of the following appending claims.

I claim:

1. An orthopedic device adapted to support the body of person having an injured or missing lower limb portion, comprising:

a mainframe member adapted to be orientated in a generally vertical disposition and having a first handle disposed proximate an upper end thereof and a foot member disposed at a lower end thereof for moveable engagement with a base surface;

a V shaped support member being interconnected at its apex to an intermediate point of said mainframe member with one of its arms extending generally upwardly to support a seat connected at its one end and its other arm extending generally upwardly and having a second handle disposed thereon, said first and second handles being adapted to be grasped by the hands of the person and said seat being adapted to vertically support the weight of the person sitting thereon;

wherein the relative positions of said seat and said foot member are such that said foot member is transversely offset from a transverse center of balance of said seat, in a direction toward the side of the injured or missing limb portion.

2. An orthopedic device as set forth in claim 1 wherein said mainframe member includes a curvilinear portion which causes said foot member to be transversely offset from an upper portion of said mainframe member.

3. An orthopedic device as set forth in claim 2 wherein said curvilinear portion is disposed between said upper portion and a generally vertically extending lower portion of said mainframe member.

4. An orthopedic device as set forth in claim 1 wherein said foot member is rectangularly shaped and connected to said mainframe lower end at a point that is closer to a trailing edge then to a leading edge thereof.

5. An orthopedic device as set forth in claim 1 wherein said seat is one that is saddle shaped.

6. An orthopedic device as set forth in claim 1 wherein said first and second handles each include laterally and forwardly extending portions such that said handles can be grasped by the persons hands with the hands being transversely spaced approximately the same distance as the shoulders of the person.

7. An orthopedic device as set forth in claim 1 wherein said V shaped support member one arm has a curvilinear portion between said apex and said one end.

8. An orthopedic device as set forth in claim 7 wherein said one end is transversely offset toward said mainframe member.

9. An orthopedic device as set forth in claim 1 and including at least one spacer element disposed between said mainframe member and said V shaped support member such that the transverse offset of said foot member can be selectively varied by changing the length of said at least one spacer element.

10. An orthopedic device as set forth in claim 1 and including a leg cradle assembly attached to and extending from said V shaped support member and adapted to supportably receive a portion of said injured lower limb thereon.

11. An orthopedic device as set forth in claim 10 and including a strap for securing said limb to said leg cradle assembly.

12. An orthopedic device as set forth in claim 10 wherein said leg cradle assembly includes means for selectively adjusting its position by a rotating portions thereof around a horizontal transverse axis.

13. An orthopedic device as set forth in claim 10 wherein said leg cradle assembly includes means for adjusting its position by rotation of portions thereof about a vertical axis.

14. An orthopedic device as set forth in claim 1 wherein said leg cradle assembly includes means for adjusting its position by rotation of portions thereof around a fore and aft extending axis.

* * * * *